United States Patent [19]

Cooper et al.

[11] Patent Number: 4,813,564

[45] Date of Patent: Mar. 21, 1989

[54] PACKAGE

[75] Inventors: Martin H. Cooper, Churchill Boro; Lyman J. Petrosky, Unity Township, Westmoreland County, both of Pa.

[73] Assignee: Westinghouse Electric Corp., Pittsburgh, Pa.

[21] Appl. No.: 160,438

[22] Filed: Feb. 25, 1988

[51] Int. Cl.[4] ..... B65D 55/02

[52] U.S. Cl. ..... 215/366; 215/250; 215/252; 206/807; 229/102; 336/200; 340/572

[58] Field of Search ..... 215/366, 250, 252, 230; 229/102; 220/214; 206/459, 807; 340/572, 550, 562, 541; 336/200

[56] References Cited

U.S. PATENT DOCUMENTS

| | | | |
|---|---|---|---|
| 1,563,731 | 12/1925 | Ducas | 336/200 |
| 2,911,605 | 11/1959 | Wales | 336/200 |
| 4,016,519 | 4/1977 | Haas | 336/200 |
| 4,021,705 | 5/1977 | Lichtblau | 336/200 X |
| 4,242,671 | 12/1980 | Plows | 340/572 |
| 4,263,584 | 4/1981 | Spirig | 340/566 |
| 4,302,846 | 11/1981 | Stephen | 340/572 X |
| 4,342,988 | 8/1982 | Thompson | 340/550 X |
| 4,369,557 | 1/1983 | Vandebult | 340/572 X |
| 4,384,281 | 5/1983 | Cooper | 340/572 |
| 4,398,089 | 8/1983 | Sharpe | 340/572 X |
| 4,484,184 | 11/1984 | Gregor et al. | 340/572 |
| 4,510,490 | 4/1985 | Anderson et al. | 340/572 |
| 4,598,276 | 7/1986 | Tait | 340/572 |
| 4,711,368 | 12/1987 | Simons | 340/572 X |
| 4,721,217 | 1/1988 | Phillips | 229/102 X |
| 4,747,499 | 5/1988 | Gach et al. | 215/250 |

*Primary Examiner*—Donald F. Norton

[57] ABSTRACT

The package includes a body and a closure. A readily breakable electrical oscillatory network sans power supply is physically connected between the body and the closure. The network is tuned to resonate at a predetermined frequency. The package is monitored by a transmitter-receiver when it is distributed to a customer. The transmitter produces pulse signals in a carrier frequency band which overlaps the resonant frequency of the network. During monitoring the package is placed in the field of the transmitter and the oscillatory network is excited to produce a decaying pulse for each transmitter pulse. The receiver is gated during the interval when each transmitter pulse is generated but is receptive of the corresponding decaying pulse from the network. If the package is sealed, the oscillatory network is intact and the receiver receives decaying pulses which produce visual or audible signals. If the package has been opened, the network is broken and no signals are produced.

11 Claims, 4 Drawing Sheets

PACKAGE

BACKGROUND OF THE INVENTION

This invention relates to the art of packaging and it has particular relationship to determining if a package which is assumed to be intact has been undesirably opened. This invention is applicable not only to bottles and boxes such as are used in the food, beverage and pharmaceutical industries, but, also, to sealed documents which may be classified or valuable. The word "package", as used in this application, includes within its meaning not only bottles and boxes, but, also, sealed documents.

Sharpe, U.S. Pat. No. 4,398,089, is typical of the prior art. Sharpe discloses a container including a radiation shell shielded from radiation detectors by a shielding shell. Sharpe states that when the container is broken, the shielding shell is ruptured and the detector picks up the radiation actuating an alarm. This expedient involves the hazards of radioactivity. In addition, Sharpe does not describe what its radiation material is and what kind of radiation it emits. Gamma radiation would require a heavy lead shield. An alpha radiation emitter such as Pu238 also emits gamma rays. The gamma rays would be present inside and outside of the container and would require shielding.

It is an object of this invention to overcome the disadvantages of the prior art and to provide for monitoring the integrity of packages without relying on radiation material.

SUMMARY OF THE INVENTION

In accordance with this invention, an electrical oscillatory network, i.e., a tuned resonant network, without a power supply is connected between the closure of a package or container and the body of a package. The network typically includes a one-turn spiral of conducting material overlapping at the inner and outer ends. This structure forms a one-turn inductance having a capacitance by reason of the overlapping ends, in parallel with the inductance, i.e., a parallel tuned network. The one-turn spiral is printed, by the methods of producing printed circuit boards, on a film of insulating material. The film seals the opening of the container. A dab of uncured adhesive is adhered to a region of the spiral. When the package is closed by the closure, the dab is engaged by the inner surface of the closure. After the adhesive is cured, the closure cannot be opened without tearing the electrically conducting spiral where the dab is adhered. The oscillatory network is thus broken.

The use of a multi-turn spiral is also within the scope of equivalents of this invention. In this case, the capacitance is formed between the innermost and outermost turns. The intervening turns serve, in effect, to reduce the dielectric distance between the innermost and outermost turns which has the effect of increasing the capacitance.

The package is monitored by a transmitter-receiver, typically under the counter over which the package is passed when purchased by a customer. The transmitter emits oscillation over a frequency band including the resonant frequency of the network. These oscillations are modulated by pulses. On the counter the electrical oscillatory network is in the field of the oscillations emitted by the transmitter. The oscillations are impressed on the network at the pulse intervals, each pulse transmitting energy to the network, exciting the network to emit a decaying pulse. After the transmission of the pulse ceases, the induced oscillations in the oscillatory network decay because of energy losses resulting from the network resistance and from electromagnetic radiation. Since the oscillatory network has a high Q, the decaying oscillations persist for an appreciable interval and can be detected. For intact packages, the receiver produces a signal corresponding to the received pulse during the interval between transmitted pulses. Typically, the signal may be an audio signal corresponding to the pulse rate. If the package is opened and the oscillatory network has been broken, then no signal is produced, indicating that the package is not intact.

BRIEF DESCRIPTION OF THE DRAWINGS

For a better understanding of this invention, both as to its organization and as to its method of operation, together with additional objects and advantages thereof, reference is made to the following description taken in connection with the accompanying drawings, in which.

DETAILED DESCRIPTION OF EMBODIMENTS AND PRACTICE OF INVENTION

Figure 1:
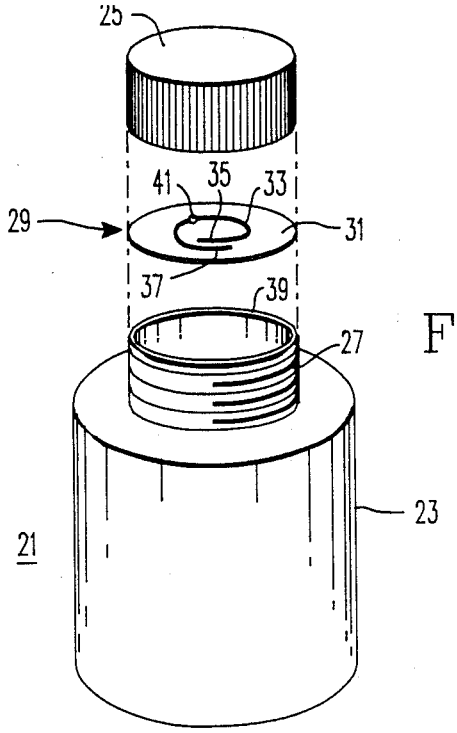
FIG. 1 is an exploded view in isometric of apparatus embodying this invention and for practicing the method of this invention.
Figure 2:
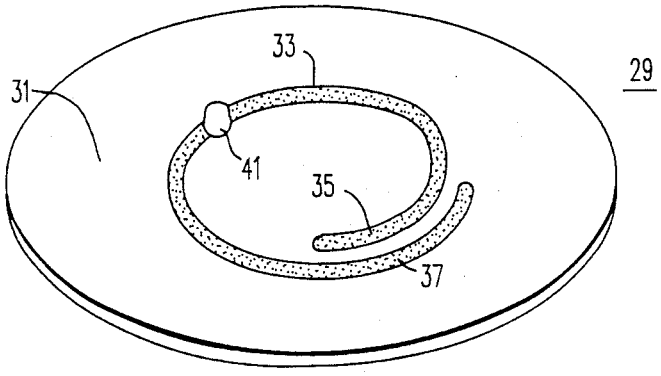
FIG. 2 is a partially diagrammatic view in isometric of an electrical oscillatory network assembly included in the apparatus shown in FIG. 1.

The apparatus shown in FIG. 1 is a package 21 including a bottle 23 and a cap 25. The bottle is open at the top and includes an external thread 27 around its rim at the top. The thread 27 is engaged by mating internal thread along the lower rim of the cap 25. An electrical oscillatory network assembly 29 is interposed between the cap 25 and the bottle 23. The assembly 29 (FIG. 2) includes a film 31 of insulating material on which a one-turn spiral 33 of electrically conducting material is printed by a printed circuit process. The spiral 33 forms an inductance. The overlapping ends 35 and 37 of the spiral are insulated from each other and form a capacitance in parallel with the inductance. The spiral 33 and its overlapping ends 35–37 form an electrically oscillatory or parallel tuned network. It is desirable that the network 33-35-37 have a high Q and to achieve this purpose, the conductors forming the spiral 33 should be highly electrically conductive.

The film 31 is sealed to the rim 39 bounding the opening in the bottle 23 after the content of the container is deposited therein. A dab 41 of uncured adhesive is deposited at a region of the spiral and the immediately surrounding film. The cap 25 is then threaded onto the thread 27 closing the bottle 23. The dab 41 of adhesive extends above the film 31 to an elevation at which it adheres to the inner surface of the cap 25 when the cap is threaded onto the bottle. When thereafter the adhesive 41 is cured, the spiral 33 is adhered to the cap 25 so that removal of the cap breaks the tuned network.

Figure 3A:
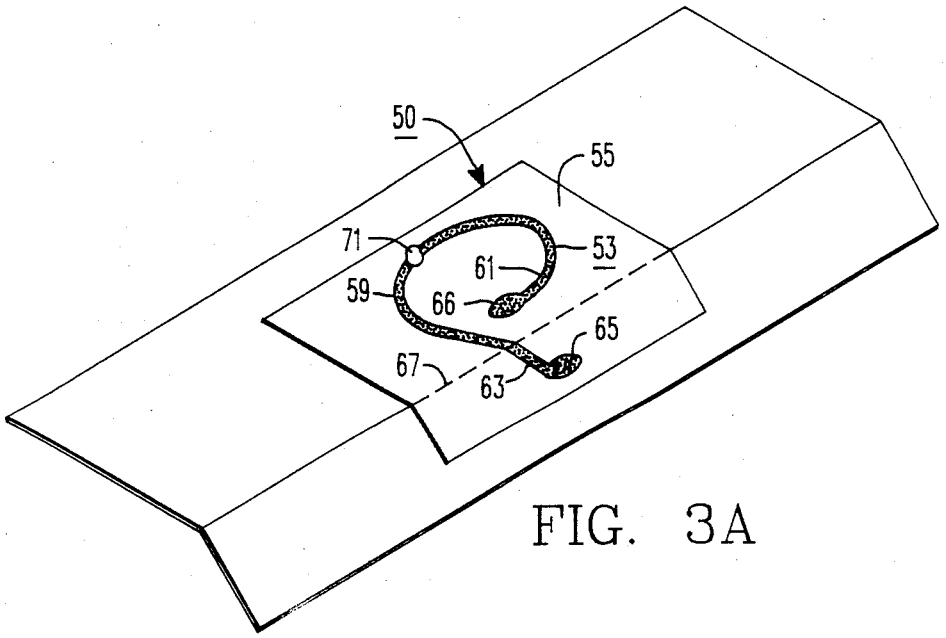
FIG. 3A is a partially diagrammatic view in isometric showing the first step in the formation of another electrical oscillatory network assembly.
Figure 3B:
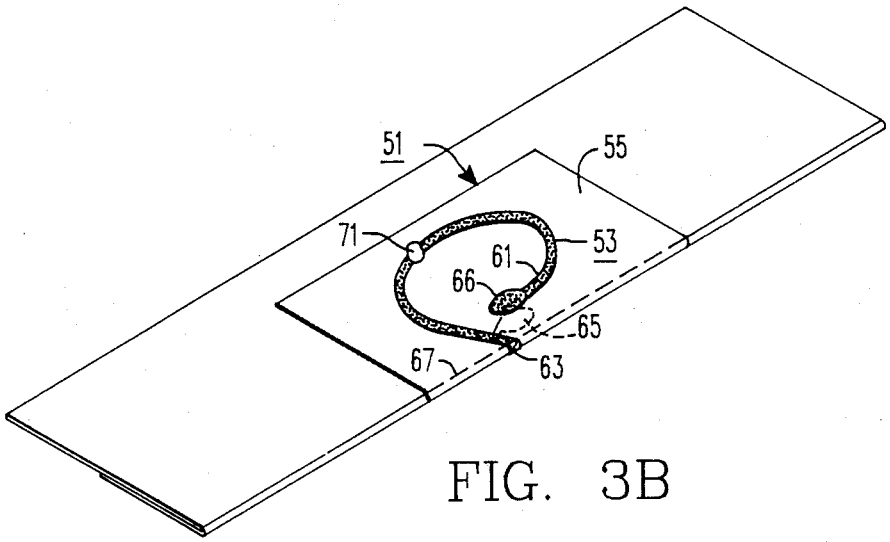
FIG. 3B is a partially diagrammatic view in isometric showing a succeeding and final step in the formation of this other electrical oscillatory network assembly.

FIGS. 3A and 3B show another electrical oscillatory network assembly 50 in preliminary state and 51 in a finished state. This assembly includes a network 53 whose capacitance is higher than for the network shown in FIGS. 1 and 2. As a first step illustrated in FIG. 3A, there is deposited on a film 55 of insulating material an electrically conducting configuration consisting of a loop 59 whose ends 61 and 63 overlap and are spaced a short distance from each other. The overlapping ends terminate in adjacent spaced conducting areas 65 and 66 which, preferably, are congruent. As a succeeding step (FIG. 3B), the film 55 is folded along a line 67 between the areas 65 and 66 substantially bisecting the space between them so that the area 65 under the fold 67 is aligned with the area 66 above the fold. The areas 65 and 66 and the film between them form a capacitor whose dielectric is the two layers of film. A dab 71 of uncured adhesive is deposited over the loop 59 and the immediately adjacent film for physically connecting to a closing part, such as the cap 25 or a flap, so that the network 53 is broken when the closing part is opened.

Figure 4:
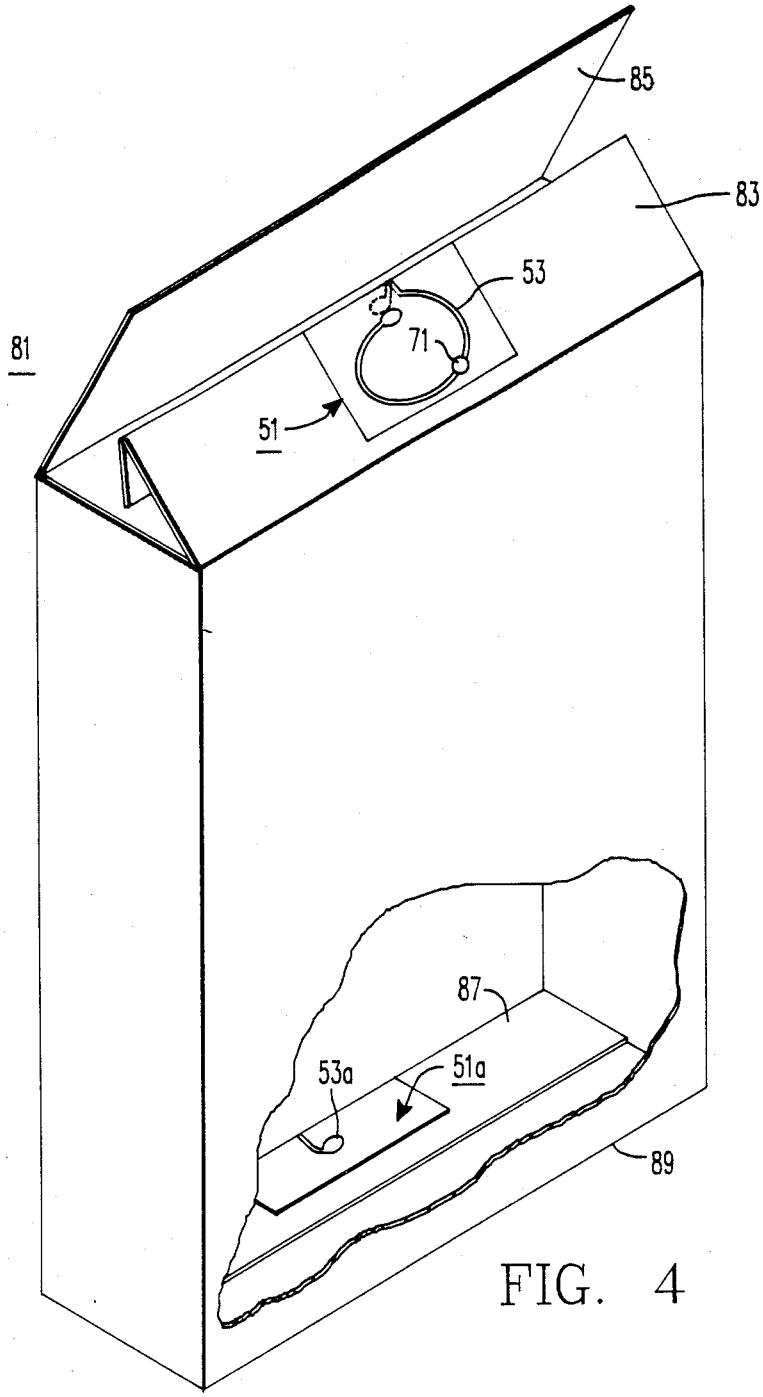
FIG. 4 is a generally diagrammatic view in isometric showing an embodiment and practice of this invention for monitoring the integrity of a package closed by flaps.

The apparatus shown in FIG. 4 includes a box 81 closed by overlapping inner and outer flaps 83 and 85 and 87 and 89 respectively at its opposite ends. An electrical oscillatory assembly 51 as shown in FIG. 3B is adhered to flap 83 and an assembly 51*a* to flap 87. After the box 81 is filled with its content, the flaps 85 and 89 are adhered to the dab 71. When the box 81 is opened at either end, the unfolding of the flap 85 and 89 breaks the network 53 and 53*a* adhered to the opposite flap 83 and 87. The networks 53 and 53*a* are tuned to different frequencies which can be distinguished readily. The difference may be effected by dimensioning the areas 65 and 66 (FIGS. 3A, 3B) of network 53 differently than the same areas for network 53*a*.

Figure 5:
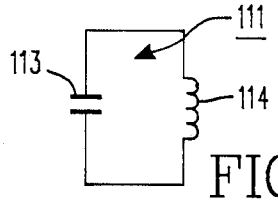
FIG. 5 is a schematic illustrating an electric oscillatory network used in the practice of this invention.
Figure 6:
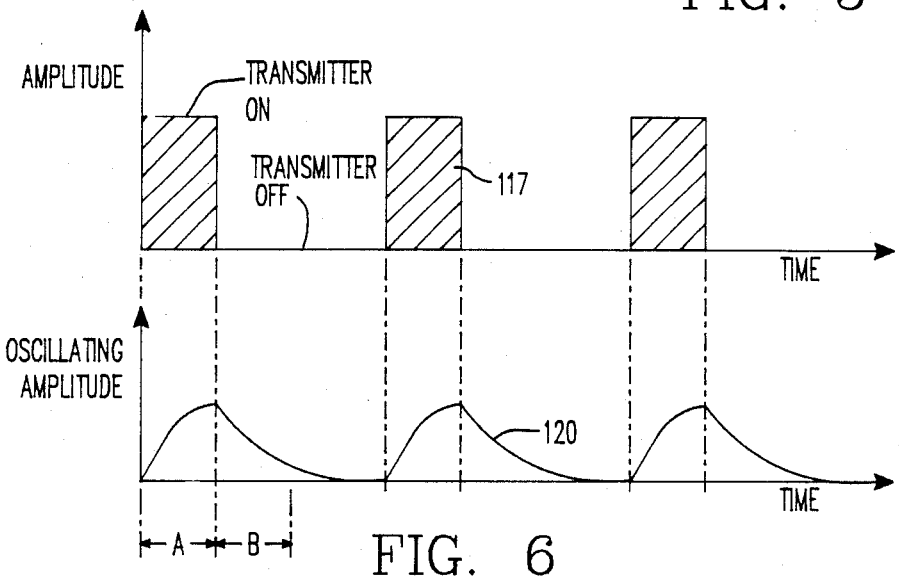
FIG. 6 constitutes a graph illustrating the operation of this invention.
Figure 7:
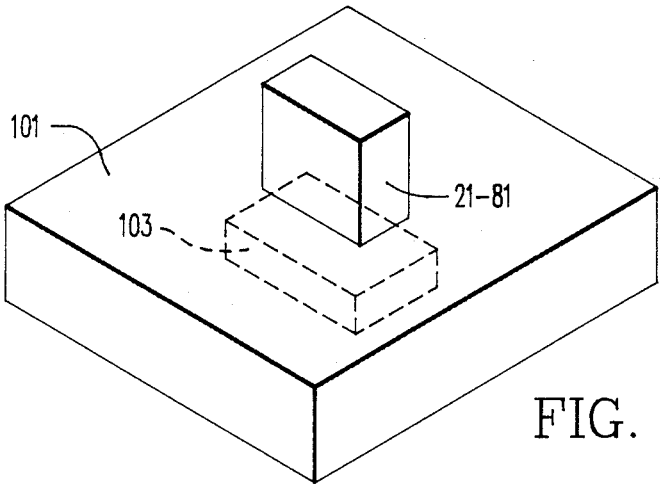
FIGS. 7 and 8 are block diagrams for showing the manner in which a package is monitored in the practice of this invention.

Packages such as 21 (FIG. 1) or 81 (FIG. 4) are monitored as they are passed over the counter 101 (FIG. 7) where a purchase is processed. Under the top of the counter 101, there is a transmitter-receiver 103. The monitoring can be understood by consideration of FIGS. 5 and 6. FIG. 5 shows schematically a parallel tuned network 111 which corresponds to the networks 33-35-37 (FIGS. 1, 2) and 53 and 53*a* (FIGS. 3B and 4). This network 111 includes a capacitance 113 and an inductance 114. As shown, the capacitor typically has a capacity C of $10^{-10}$ Farads and an inductance L of $10^{-6}$ Henrys. The resonant frequency is $1/\sqrt{LC}$ or $1\sqrt{10^{-16}}=10^{8}$ Hertz. For monitoring the package 21, the transmitter-receiver 103 includes a transmitter 115 which produces pulse modulated trains of oscillation 117 (FIG. 6*a*). The carrier oscillations are typically over a frequency band peaking at $10^{8}$ Hertz. Typically, the duty cycle of the pulses is 10% and the power output of the transmitter 115 is 0.1 milliwatt pulse power. For package 81, the transmitter 115 and receiver 119 are constructed to produce alternate pulse modulated oscillations whose carriers peak at the different frequencies to which networks 53 and 53*a* are tuned. This enables the moitoring simultaneously both ends of the package 81 to determine if the flaps 83–85 or 87–89 have been opened.

Figure 8:
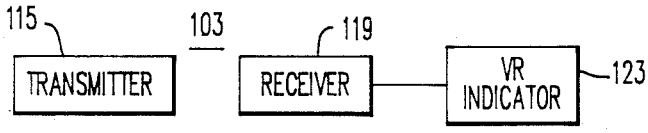

The package 21-81 is positined typically about 1-foot from the transmitter 115 in the field of output of the transmitter. The receiver 119 is blocked during the transmitter pulse 117 (FIG. 6) and is gated having a nominal threshold typically of 1 microwatt at $10^{8}$ Hertz. On receiving a pulse from the transmitter 115, the capacitor 113 is charged and the network 33-35-37 or 53 or 53*a* is set into oscillation producing decaying oscillations 120 (FIG. 6). The resulting emissions are received and detected by the receiver 119, following the interval during which each transmitter pulse is blocked, thus producing a train of decaying pulses 120 (FIG. 6) having trailing ends. The trailing ends constitute a train of detectable emissions picked up by the receiver. The transmitter-receiver 103 includes an audio or visible indicator 123 (FIG. 8). If the package 21-81 is intact, the indicator 123 produces a signal corresponding to the train of detected emissions, if not, no signal is produced. This process may be reversed. The indicator may be set to produce a signal when a break is detected in the package 21-81. To prevent the indicator from producing signals between moitoring operations, the detector may be gated, for example, by a normally-open microswitch under the counter, which is closed by a package 21-81 when it is place on the counter.

While preferred embodiments and preferred practice of this invention have been disclosed herein, many modifications thereof are feasible. This invention should not be restricted, except insofar as is necessitated by the spirit of the prior art.

We claim:

1. A closed container including a body and a closure for closing said body, at least one electrical oscillatory network having no power supply including a capacitor and an inductor, and means connecting said network at one region thereof to the internal surface of said closure and at another region thereof to said body so that when said container is opened by removal of said closure from said body said network is broken.

2. The closed container of claim 1 wherein the container is a bottle having a body sealed by a cap and the oscillatory network is connected to the cap in one region thereof and to the body in another region thereof.

3. The closed container of claim 1 wherein the container is a package having closures at each end including associated overlapping flaps including an outer flap and an inner flap having abutting surfaces when the container is closed, said container including a pair of electrical oscillatory networks, each including a capacitor and an inductor, and, means connecting one network to the abutting surfaces of the associated overlapping flaps at one end and the other network to the abutting surfaces of the associated flap at the other end so that on the opening of the outer flap at either end the network is broken.

4. A container having a body having an opening and a cap closing said opening, a film of electrically insulating material connected to said opening to seal said opening under said cap, an electrical oscillatory network including a capacitor and an inductor secured to the outer surface of said film, and means connecting said network to the inner surface of said cap so that on the removal of said cap from said body said network is broken.

5. A container having at each of the opposite ends thereof inner and outer flaps for closing said container, first and second electrically oscillatory networks, each network including a film of electrically insulating material having secured thereto a capacitor and an inductor, means securing said film of said first network to one of a first pair of sufaces consisting of the inner surface of said outer flap and the outer surface of said inner flap at one of said opposite ends, means connecting said first network to the other of said first pair of surfaces, and means securing said film of said second network to one of a second pair of surfaces consisting of the inner surface of the outer flap and the outer surface of the inner flap at the other of said opposite ends, and means connecting said second network to the other of said second pair of surfaces.

6. The container of claim 5 wherein the first and second oscillatory networks are tuned to distinguishably different frequencies.

7. A method for electrically determining if a package, having a closure and a body closed by said closure, has been previously undesirably opened; comprising: producing a readily breakable electrical oscillatory network sans power supply, said network having a predetermined resonant frequency, securing said oscillatory network between said body and said closure in such manner that opening of said closure breaks said network, generating a signal having a frequency band overlapping the resonant frequency of said network, positioning said package including said network in the field of said generated signal so that said network if intact is set into oscillation by said signal, and monitoring the field of said oscillation to determine if said network is in oscillation thereby to determine if said package has been opened.

8. The method of claim 7 wherein the electrically oscillatory network includes an inductor and a capacitor and in producing the electrical oscillatory network said inductor is formed by bowing a wire into a single-turn coil with the outer end and the inner end of the wire overlapping over a predetermined angle, and insulated from each other, said inner and outer overlapping ends forming said capacitor.

9. The method of claim 7 including the step of mounting the electrical oscillatory network on a thin film of electrically insulating material, sealing the container with said film and connecting the network to the closure whereby the network is broken when the closure is opened and the film is penetrated.

10. The method of claim 7 wherein the electrical oscillatory network is connected between the closure and the body so that when the closure is opened the network is broken.

11. A method of providing a package having a body having an opening and a closure for closing said opening with means for determining if said package has been undesirably opened, the said method comprising printing an electrical oscillatory network on a film of insulating material, sealing said opening with said film, depositing a dab of uncured adhesive in contact with said network, closing said opening with said closure so that said dab is adhered to the inner surface of said closure, and permitting said adhesive to be cured whereby when said closure is undesirably removed said dab and a portion of said network adhered thereto are removed and said network is broken.

* * * * *